United States Patent [19]

Lang et al.

[11] Patent Number: 4,628,800

[45] Date of Patent: Dec. 16, 1986

[54] BAFFLE ASSEMBLY FOR USE WITH A LATERAL DUCT OF AN AIR CONDITIONING SYSTEM

[75] Inventors: Richard D. Lang, Chittenango; Cosimo Caronna, Syracuse, both of N.Y.

[73] Assignee: Carrier Corporation, Syracuse, N.Y.

[21] Appl. No.: 721,029

[22] Filed: Apr. 8, 1985

[51] Int. Cl.[4] ..... F24F 13/10

[52] U.S. Cl. ..... 98/41.1; 98/40.19; 98/106; 137/875; 251/297

[58] Field of Search ..... 98/39, 40.01, 40.19, 98/40.28, 40.18, 41.1, 94.2, 102, 106, 114; 137/862, 875; 251/220, 297, 298

[56] References Cited

U.S. PATENT DOCUMENTS 2,718,187 9/1955 Frisby ..... 98/41.1 X 4,316,408 2/1982 Bolton et al. ..... 98/41.1

FOREIGN PATENT DOCUMENTS 71281 11/1946 Norway ..... 98/41.1

191397 1/1964 Sweden ..... 98/41.1

*Primary Examiner*—Harold Joyce

*Attorney, Agent, or Firm*—Robert H. Kelly

[57] ABSTRACT

Apparatus for regulating air flow through a housing is disclosed. A baffle assembly including a ramp-like keeper is provided such that detents on the keeper contact the edge of the baffle to secure the baffle in position. When the baffle reaches a top position along the keeper it contacts a cam and returns to its initial position. The combination arrangement is utilized to either regulate the flow of air being discharged from the unit or to divert air between multiple outlets in the housing.

7 Claims, 5 Drawing Figures

BAFFLE ASSEMBLY FOR USE WITH A LATERAL DUCT OF AN AIR CONDITIONING SYSTEM

BACKGROUND OF THE INVENTION

This invention relates generally to a baffle assembly for diverting the flow of a gaseous fluid. More specifically, the present invention relates to an adjustable baffle assembly for regulating the flow of conditioned air in a packaged terminal air conditioning unit including a ramp like keeper member for securing the baffle in various positions and a cam at the end position for initiating the return of the baffle to the starting position.

Air conditioning units which are commonly used for light commercial applications such as hotels, dormitories, and office buildings often are of the type known as a Packaged Terminal Air Conditioning (PTAC) unit. These Packaged Terminal Air Conditioners extend through the wall of the enclosure and normally have a condensing section located for discharging heat energy to the ambient sink of the atmosphere. An evaporator section of the unit is provided in communication with the enclosure air for conditioning said air as it is drawn through the unit.

These units are usually positioned through an exterior wall of the enclosure to be conditioned. Often it is desirable to treat the air in one or more adjacent enclosures utilizing a single packaged terminal air conditioning unit. To accomplish this, an adapter is inserted into the normal air discharge flow path of the packaged terminal air conditioning unit. This adapter has a duct extension connected thereto for directing the conditioned air into the room adjacent to the one containing the packaged terminal air conditioning unit. Further, the adapter has a damper assembly for directing a portion of the conditioned air to either the room containing the packaged terminal air conditioning unit or the adjacent room, or both.

Previous baffle assemblies for packaged terminal air conditioners included a flexible leaf spring for securing the damper in various positions. However, the frictional force provided by the spring against the damper, which acted to secure the baffle in a fixed position, would not permit automatic return of the baffle to its starting position. To return the baffle to its starting position, after the baffle had been moved in one direction by using a tool extending through the louvers of discharge grille, required the disassembly of the duct adapter to move the baffle in the opposite direction along the leaf spring.

The baffle assembly hereinafter described is suitable for use in an adapter to regulate the flow of air being discharged from a single unit to an adjacent room, either to the right or to the left of the unit, without removing any parts of the unit to adjust the air baffle.

SUMMARY OF THE INVENTION

It is an object of the present invention to provide a baffle assembly for regulating the flow of air.

It is a further object of the present invention to provide a pivotally mounted baffle which slides up a ramp to position the baffle.

It is another object of the present invention to provide a return means which moves the baffle from a starting position to an end position and back to the starting position.

It is still a further object of the present invention to provide a baffle which is economical to manufacture, simple in construction, and easy to operate and adjust the air flow between adjacent rooms.

These and other objects of the present invention are attained by means of a duct adapter attached to the chassis of a packaged terminal air conditioning unit having an air baffle to control the direction of air flow from the unit. The baffle is housed in a duct adapter defining an air flow path. The duct adapter has walls which define both an inlet and at least two outlets. The baffle is pivotally mounted to control air flow to the outlets. A fixed ramp curves inwardly and upwardly in an arc which corresponds to the path of travel of the leading edge of the baffle. The ramp has a plurality of detents along its front edge to movably secure the baffle at various positions. The ramp further has a camming surface located near its lower portion and the adapter has another camming surface formed thereon, both of which assist in returning the baffle to its initial starting position.

The various features of novelty which characterize the invention are pointed out with particularity in the claims annexed to and forming a part of this specification. For a better understanding of the invention, its operating advantages and specific objects attained by its use, reference should be had to the accompanying drawings and descriptive matter in which there is illustrated and described a preferred embodiment of the invention.

BRIEF DESCRIPTION OF THE DRAWINGS

In the accompanying drawings, forming a part of this specification, and in which reference numerals shown in the drawings designate like or corresponding parts throughout the same.

DESCRIPTION OF THE PREFERRED EMBODIMENT

The apparatus as described herein will refer to a specific application with a packaged terminal air conditioning (PTAC) unit. It is to be understood that this baffle assembly has like applicability to all types of air conditioning units and in general to the regulation of an air flow stream through a housing. The application of this baffle assembly is not limited to air conditioning units or even to air as the gaseous media flowing therethrough. Further, the damper assembly will act to divert air between one of two outlets of the duct adapter. A description of the present invention in reference to an embodiment regulating flow between two outlets is not intended to limit this application.

Figure 1:
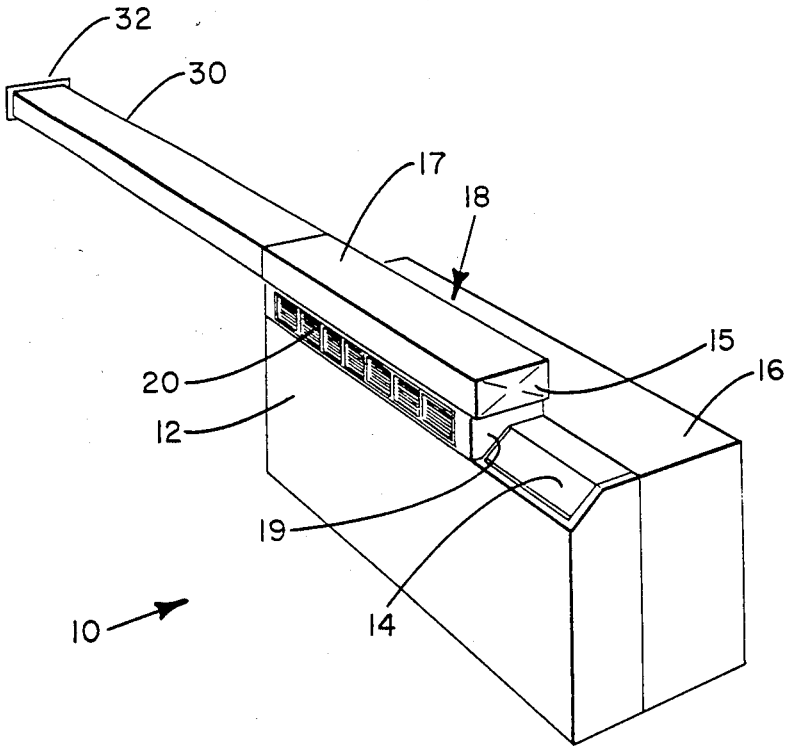
FIG. 1 is an isometric view of a packaged terminal air conditioning unit having a duct adapter and lateral duct extension for discharging air into two adjoining rooms.

Referring now to the drawings and, in particular, to FIG. 1, there is shown a packaged terminal air conditioning unit having a duct adapter 18 and a duct extension 30 for use in supplying conditioned air to adjacent enclosures. The air conditioning unit 10 is shown having a front cover 12, wall sleeve 16, and control door 14. The control door is mounted to cover the controls for regulating the operation of the unit.

Duct adapter 18 is inserted into the air discharge opening (not shown) of the unit when it is desired to provide conditioned air to more than one enclosure from a single unit. As shown in FIG. 1, the duct adapter 18 is mounted to the unit by way of lower housing member 19. The lower housing member 19 has an upper housing member 17 attached to the front and top thereof, and a discharge grille 20 mounted at the front of the duct adapter such that a portion of the air discharged from unit 10 is discharged through grille 20. The duct extension 30 is mounted at one end of duct adapter 18 and has an air register 32 mounted at the opposite end of the duct extension. The upper housing member has an end plug 15 secured to the end opposite the duct extension 30. When assembled, the duct adapter and duct extension will normally discharge conditioned air into an adjoining room through air register 32 and into the room containing the unit through discharge grille 20. It is to be understood that, by removing the duct extension and the end plug 15, and reversing their positions, air may be discharged into an adjoining room to either the right or left of the unit.

Under normal circumstances, air is drawn into the unit through louvers (not shown) in front cover 12 or the bottom of the cover and is conditioned and discharged at the left of the unit through the duct adapter and/or duct extension.

It is to be understood that adapter 18 as shown in FIG. 1 is mounted to the unit at the normal opening covered by a discharge grille. However, when the duct adapter and extension is used in conjunction with a PTAC unit the chassis discharge grille is removed and the lower housing member 19 is positioned over the chassis discharge opening such that air being discharged from the evaporator is discharged into adapter 18 rather than discharged through the normal grille into the conditioned space.

Figure 2:
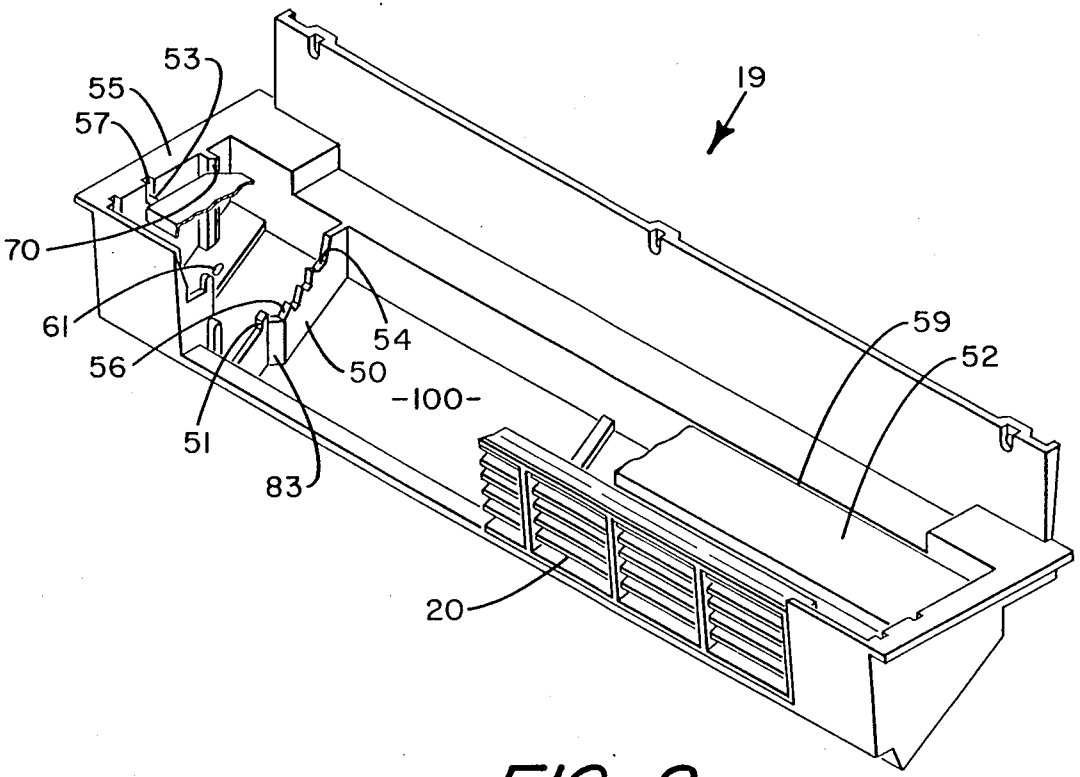
FIG. 2 is a partially cut-away isometric view of a duct adapter for a packaged terminal air conditioning showing an air baffle assembly for discharging a portion of the discharge air to the adjoining room.

FIGS. 2–5 disclose the details of duct adapter 18. FIG. 2 is an isometric view of the lower housing member 19 of the duct adapter 18 with the upper housing member 17 removed in order to more clearly see the air baffle assembly. The lower housing member 19 of the duct adapter 18 is shown having an inlet 100 at the bottom of the housing member which receives conditioned air from the unit, an air discharge grille 20, and an adjustable air baffle assembly including an air baffle 52, a ramp-like keeper member 50, and a camming surface 70. It should be noted that air discharge grille 20 may be inserted in different positions for different desired room air flow directions, for upward air flow, the louvers are pointed up and for downward air flow, e.g. when the unit is installed high on a wall, the louvers are pointed down.

The right pivot rod cradle opening 57 is not as deep as the left pivot rod cradle opening. The lower housing member 19 has a pivot support 55 shown having a pivot rod cradle opening 57 to provide a rotational support for the air baffle pivot rod 53 upon which the air baffle 52 is mounted. The pivot supports and cradle openings are provided at both ends of the lower housing member 19 such that the air baffle is pivotally mounted relative thereto. The lower housing member 19 is positioned over the chassis discharge opening and may be attached to the chassis with fasteners inserted through aperture 61.

Figure 3:
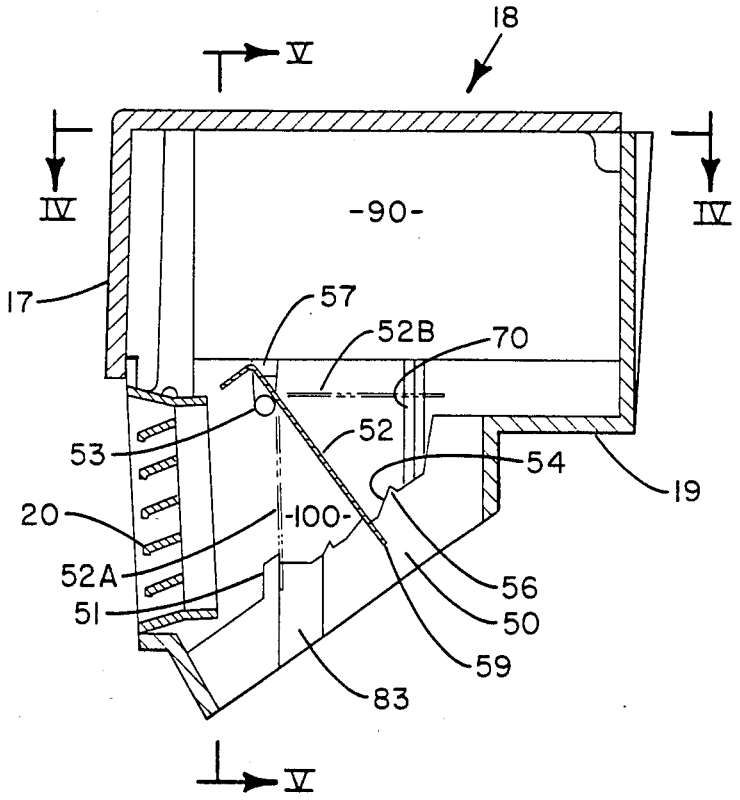
FIG. 3 is a sectional end view of a duct adapter for a packaged terminal air conditioning unit including the air baffle assembly of the present invention.
Figure 4:
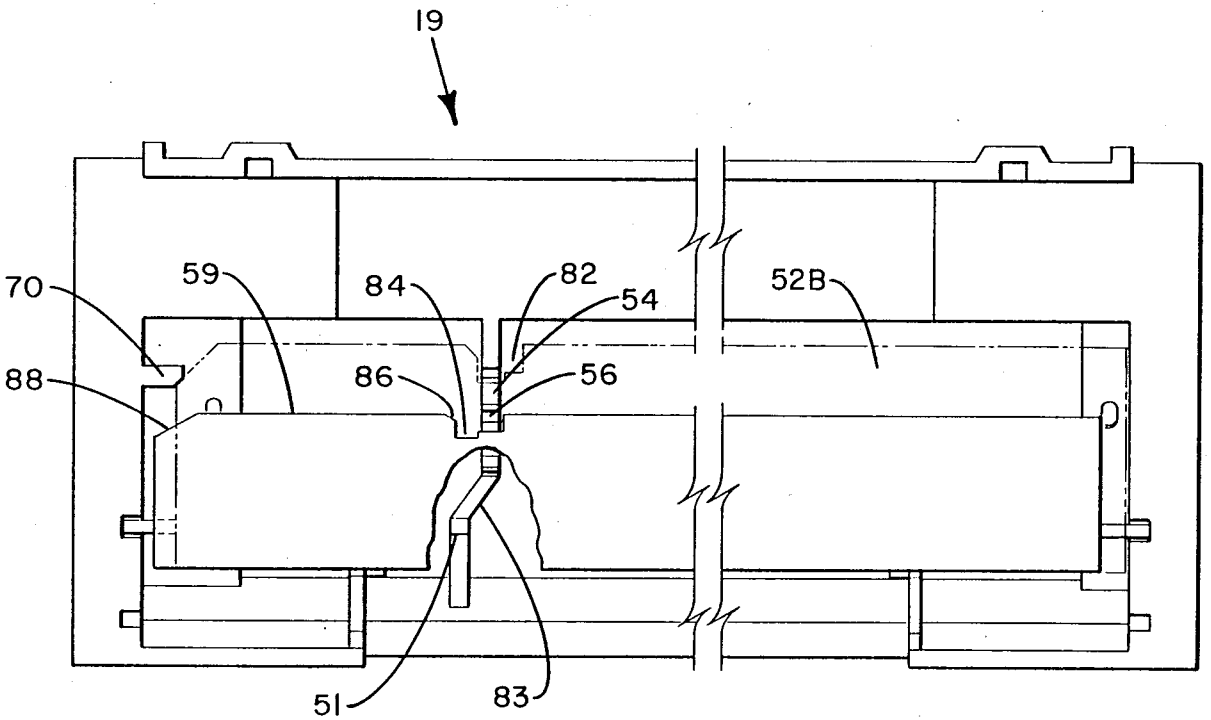
FIG. 4 is a partially cut-away plan view of the duct adapter taken along line IV—IV as shown in FIG. 3.

As can be seen in FIGS. 2–4, the ramp-like keeper member 50 is provided to adjustably fix the air baffle 52 at various positions along its path. In the embodiment illustrated this keeper member has an arcuate front surface 54 with a plurality of detents 56 protruding therefrom. The arcuate front surface 54 of the keeper member 50 is curved to generally correspond to the projected path of the bottom edge 59 of the air baffle 52 as it pivots from its starting position to its top position. As the baffle 52 is rotated from its starting position, indicated as 52A in FIG. 3, to its top position, indicated as 52B in FIG. 3, the air baffle directs different amounts of air to the two rooms. In its starting position, the baffle directs 40% of the discharge air to the adjoining room while 60% of the discharge air is directed to the room containing the unit. Moreover, when the baffle is in its top position, 90% of the air is directed to the unit room while 10% is directed to the adjoining room.

As can be seen in FIG. 3 the duct adapter 18 forms a housing including lower housing member 19, upper housing member 17, air discharge grille 20, and air baffle 52 which, depending upon the position of the air baffle 52 allows air flowing through the housing to be discharged through the air discharge grille 20 or through outlet 90 to a duct extension for discharge into an adjoining room.

Figure 5:
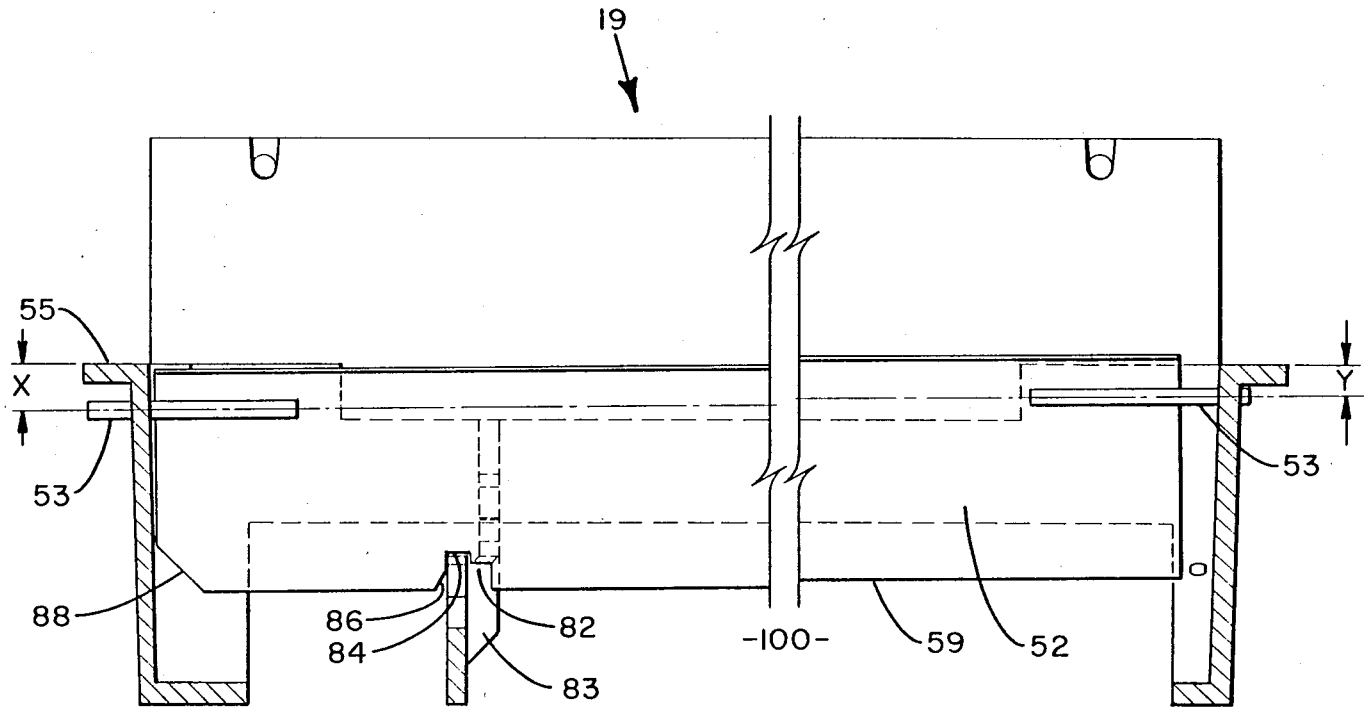
FIG. 5 is a sectional view of the duct adapter taken along line V—V of FIG. 3.

In operation, the air baffle 52 is adjusted, as can be seen in FIG. 3, by inserted a small diameter object, such as a screwdriver, between the louvers of air discharge grille 20 and pushing on the air baffle 52 until it pivots on its pivot rods 53 and slides up arcuate front surface 54 of ramp-like keeper member 50. The air baffle 52 is thus moved along keeper member 50. However, to ensure that the air baffle 52 automatically returns to its starting position after reaching the top position, the bottom edge of the baffle 59, as shown in FIGS. 4–5, has a small inwardly projecting notch 82, a larger inwardly projecting notch 84 adjacent thereto, and a notched camming surface 86 extending from the larger notch 84. The main purpose of the small inwardly projecting notch 82 is to contact the keeper member 50 and position the air baffle 52 at various detents 56 along the keeper member 50 as the air baffle is pivoted in an upward direction. Further, the air baffle 52 is also provided with a camming surface 88 which coacts with cam 70 as the air baffle approaches its top position. As the camming surface 88 moves along cam 70 the air baffle 52 is moved laterally to the right as shown in phantom in FIG. 4. Accordingly, when the air baffle reaches its top position and has been moved laterally in its pivot rod cradle openings the small inwardly projecting notch 82 is no longer in contact with the ramp-like keeper member 50, but the larger inwardly projecting notch 84 is positioned over the keeper member 50 so that the air baffle now pivots downwardly by gravitational force and comes to rest on ramp stop 51. However, as the baffle approaches its starting position an angled portion 83 of keeper member 50 coacts with the sides of larger inwardly projecting notch 84 and the air baffle is thus laterally shifted to the left as shown in FIG. 4 whereby the small inwardly projecting notch 82 is again positioned above the keeper member 50 so that the air baffle may be adjusted again in an upward direction. Still further, to ensure that the air baffle 52 does not move laterally before it reaches its top position, e.g. moving to the right due to the air baffle vibrating, the left pivot rod cradle opening is deeper, shown as the distance "X", than the right pivot rod cradle opening, shown as the distance "Y", and the air baffle 52 is sloped down to the left. Accordingly, the side of the small inwardly projecting notch 82 is in frictional contact with the side of the ramp-like keeper member 50 as the air baffle moves up the keeper member.

As shown in FIGS. 3 and 4 the air baffle 52 is moved from its starting position 52A upwardly as the small inwardly projecting notch 82 slides along ramp-like keeper member 50, stopping at any intermediate position at detents 56, until it reaches its top position. When the air baffle 52 reaches its top position cam 70 coacting with camming surface 88 laterally moves the air baffle to the right so that the larger inwardly projecting notch 84 allows the air baffle to rotate from position 52B back to position 52A. Moreover, the angled portion of keeper member 83 acts as a cam to force the air baffle 52 back to the left so that the small inwardly projecting notch 82 is again above the keeper member so that the air baffle can be upwardly adjusted again.

Thus, the invention provides an improved air baffle that overcomes many of the disadvantages of the prior art.

While this invention has been described with reference to the structure disclosed herein, it is not confined to the details set forth herein and this application is intended to cover any modifications or changes as may come within the scope of this invention.

What is claimed is:

1. A device for directing the flow of a fluid which comprises:

a housing having an inlet and at least one outlet, said device defining a fluid flow path from said inlet to said outlet;

a pivotally mounted baffle located to obstruct the fluid flow path, said baffle including a first notch portion therein, said baffle being rotated between various positions to effect differing impediments to the fluid flow along said path;

means for securing said baffle in a plurality of preselected positions including an arcuate keeper member fixed across said inlet to engage said baffle such that said first notch portion of said baffle contact said keeper member to maintain said baffle in said preselected positions as said baffle moves along said arcuate keeper member; and means for returning said baffle from a last position to a first position in said plurality of preselected positions including a camming surface fixedly mounted on said housing in coacting relation with said baffle when said baffle is moved beyond said last position, whereby said baffle moves out of engagement with said arcuate keeper member and moves to said first position.

2. The device as set forth in claim 1 wherein said arcuate keeper member includes a plurality of detents engaging said first notch portion of said baffle.

3. The device as set forth in claim 2 wherein said means for returning said baffle from said last position to said first position includes a second notch portion of said baffle, immediately adjacent said first notch portion of said baffle, in spaced relation to said detents when said baffle moves out of engagement with said arcuate keeper member.

4. The device as set forth in claim 3 wherein said means for returning said baffle from said last position to said first position includes an angled portion of said arcuate keeper member in coacting relation with said second notch portion of said baffle to slidably move said first notch portion of said baffle into engagement with said arcuate keeper member.

5. A lateral duct assembly in combination with a packaged terminal air conditioner for directing the flow of conditioned air into adjacent rooms, the lateral duct assembly comprising:

an adapted housing having an inlet for receiving conditioned air from the packaged terminal air conditioning unit, a first outlet for discharging conditioned air to a room, and a second outlet for discharging conditioned air to an adjacent room;

a baffle assembly mounted for pivotal rotation relative to said housing, said baffle having a bottom edge adjacent said inelt such that said baffle may be positioned, a trailing edge, and two ends connecting the bottom edge to the trailing edge, to impede conditioned air flow to the first outlet thereby diverting a portion of the conditioned air flow to said second outlet, said bottom edge having a first notch portion therein, said baffle having one end higher than the opposite end whereby said baffle slopes down to one end;

means for securing said baffle in a selected position, said means including an arcuate keeper member fixed transversely across said inlet to engage said first notch portion of said baffle as said baffle is moved from a first position impeding conditioned air flow to said first outlet to at least a second position impeding conditioned air flow to said second outlet; and returning means for moving said baffle from said at least second position to said first position including a camming surface fixedly attached to said housing in coacting relation with said baffle to laterally move said baffle out of engagement with said arcuate keeper member whereby said baffle pivotally returns to said first position.

6. A lateral duct assembly as set forth in claim 5 wherein said arcuate keeper member includes a plurality of detents engaging said first portion of said baffle.

7. The lateral duct assembly as set forth in claim 6 wherein said return means includes a second notch portion of said baffle and an angled portion of said arcuate keeper member frictionally engaged with said second notch portion of said baffle for laterally moving said baffle to a position such that said first notch portion of said baffle engages said arcuate keeper member.

* * * * *